US008176588B2

(12) United States Patent
Lin

(10) Patent No.: US 8,176,588 B2
(45) Date of Patent: May 15, 2012

(54) INFLATABLE FURNITURE

(76) Inventor: Martin Lin, Taichung (TW)

( * ) Notice: Subject to any disclaimer, the term of this patent is extended or adjusted under 35 U.S.C. 154(b) by 304 days.

(21) Appl. No.: 12/652,701

(22) Filed: Jan. 5, 2010

(65) Prior Publication Data

US 2010/0123347 A1 May 20, 2010

Related U.S. Application Data

(63) Continuation-in-part of application No. 12/274,259, filed on Nov. 19, 2008, now abandoned.

(51) Int. Cl.
*A47C 17/82* (2006.01)
*A47C 27/10* (2006.01)

(52) U.S. Cl. .. 5/713; 5/655.3; 5/710; 190/2; 297/452.41

(58) Field of Classification Search ..... 5/706, 710, 5/713, 655.3, 420; 297/17, 452.41, DIG. 3; 190/2; 383/4
See application file for complete search history.

(56) References Cited

U.S. PATENT DOCUMENTS

| | | | | |
|---|---|---|---|---|
| 2,542,477 | A * | 2/1951 | Cart | 441/125 |
| 4,153,958 | A * | 5/1979 | Paulik | 5/12.1 |
| 4,169,295 | A * | 10/1979 | Darling | 5/706 |
| 6,951,039 | B2 * | 10/2005 | Roseff | 5/706 |
| 7,444,705 | B2 * | 11/2008 | Chang | 5/713 |
| 7,555,797 | B1 * | 7/2009 | Wu | 5/710 |
| 7,647,662 | B2 * | 1/2010 | Wang | 5/713 |
| 2010/0123347 | A1 * | 5/2010 | Lin | 297/452.41 |
| 2011/0056788 | A1 * | 3/2011 | Jackson | 190/2 |

FOREIGN PATENT DOCUMENTS

GB 2061712 A * 5/1981

* cited by examiner

*Primary Examiner* — Michael Trettel

(57) ABSTRACT

An inflatable furniture comprises: a receiving body, a plurality of side-board-connecting members, airbag-connecting members, a pump, a power supply, two airbags, and an audio device. By opening the side boards and inflating the airbags, the airbags can be inflated into beds or sofas, and when after use, the airbags can be deflated and folded into the receiving body. Furthermore, the receiving body can also be temporarily used as a tea table or a stool.

11 Claims, 12 Drawing Sheets

INFLATABLE FURNITURE

This application is a continuation of part of U.S. patent application Ser. No. 12/274,259, which claims the benefit of the earlier filing date of Nov. 19, 2008 now abandoned. Claim 1 of this application is revised from the claim 1 of the U.S. patent application Ser. No. 12/274,259, claims 2, 3, 5, 9, 10 and 11 of this application are new, claims 4, 6, 7, and 8 correspond to claims 5, 12, 4 and 11 of the U.S. patent application Ser. No. 12/274,259, respectively.

BACKGROUND OF THE INVENTION

1. Field of the Invention

The present invention relates to a kind of furniture, and more particularly to inflatable furniture.

2. Description of the Prior Art

Home is a place for people to rest and relax after a whole day work, and each home has various kinds of furniture, such as sofa and bed. Normally, furniture usually has a large size and is not collapsible, it will occupy a large space when it is placed in a room which is rarely used, such as a guest room. Therefore, inflatable furniture appeared in the market, it can be deflated after use and then put in the cabinet or store room. However, the user might forget where the deflated furniture was put and forget to use it.

The present invention has arisen to mitigate and/or obviate the afore-described disadvantages.

SUMMARY OF THE INVENTION

The primary objective of the present invention is to provide an inflatable furniture set which is simply structured and convenient for storage.

To achieve the objective of the present invention, the inflatable furniture comprises: receiving body, a plurality of side-board-connecting members, airbag-connecting members, a pump, a power supply, two airbags, and an audio device. The receiving body has a receiving space and two side boards capable of being opened laterally, each of the side boards is provided with a zipper around its outer periphery for allowing the side boards to be zipped up to close the receiving space or allowing the side boards to be unzipped and lay on the ground. The plurality of side-board-connecting members is connected to an inner surface of the respective side boards. The pump is connected to the receiving body. The power supply is electrically connected to the pump and at least one rotary control button which controls ON/OFF of the pump. The two airbags are connected to the pump and capable of being inflated into furniture by the pump when the side boards are opened. The plurality of airbag-connecting members are disposed on the airbags and located corresponding to the side-board-connecting members on the side boards of the receiving body, when the side boards of the receiving body are opened, the airbag-connecting members the airbags and the side-board-connecting members enable the airbags to be connected to or detached from the side boards.

By opening the side boards and inflating the airbags, the airbags can be inflated into beds or sofas, and when after use, the airbags can be deflated and folded into the receiving body. Furthermore, the receiving body can also be temporarily used as a tea table or a stool.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
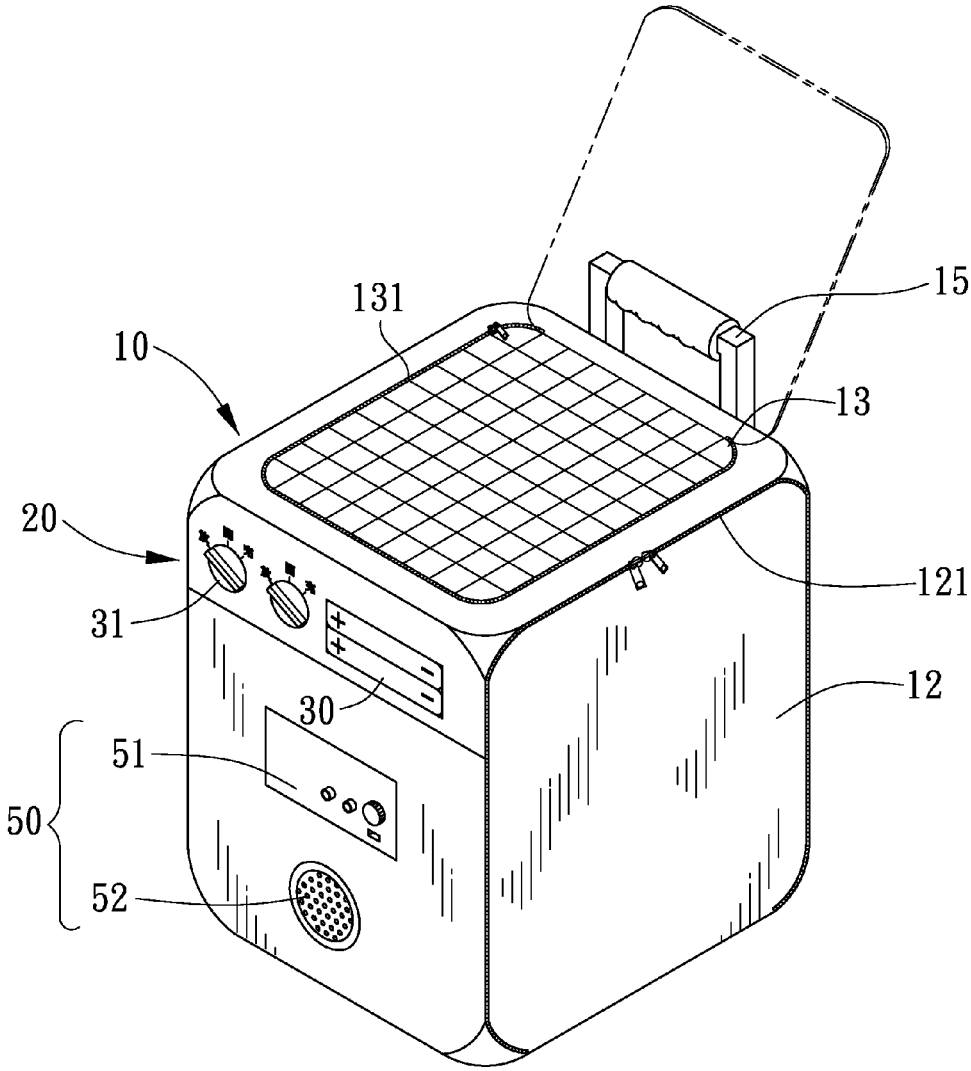
FIG. 1 is a perspective view of an inflatable furniture with a DC power supply in accordance with the present invention.

Referring to FIGS. 1-6, an inflatable furniture in accordance with the present invention comprises a receiving body 10, a plurality of side-board-connecting members, airbag-connecting members, a pump 20, a power supply 30, two airbags 40, and an audio device 50.

The receiving body 10 takes the form of a luggage case and is provided with a receiving space 11 and two side boards 12 which can be opened laterally. Each of the side boards 12 is provided with a zipper 121 around its outer periphery so that the side boards 12 are zipped up to close the receiving space 11. Furthermore, an outer surface of the top of the receiving body 10 can be provided with a chessboard 13, such as, Chinese chess, Caissa Chess, five chess and so on. The chessboard 13 is provided around its outer periphery with a zipper 131, so that the receiving space 11 can be closed or opened when the chessboard 13 is zipped or unzipped by the zipper 131.

The side-board-connecting members are connected to an inner surface of the respective side boards 12, they can take the forms of pressing buckles 122, zippers 123 or hooks and loops fastener 124.

Figure 2:
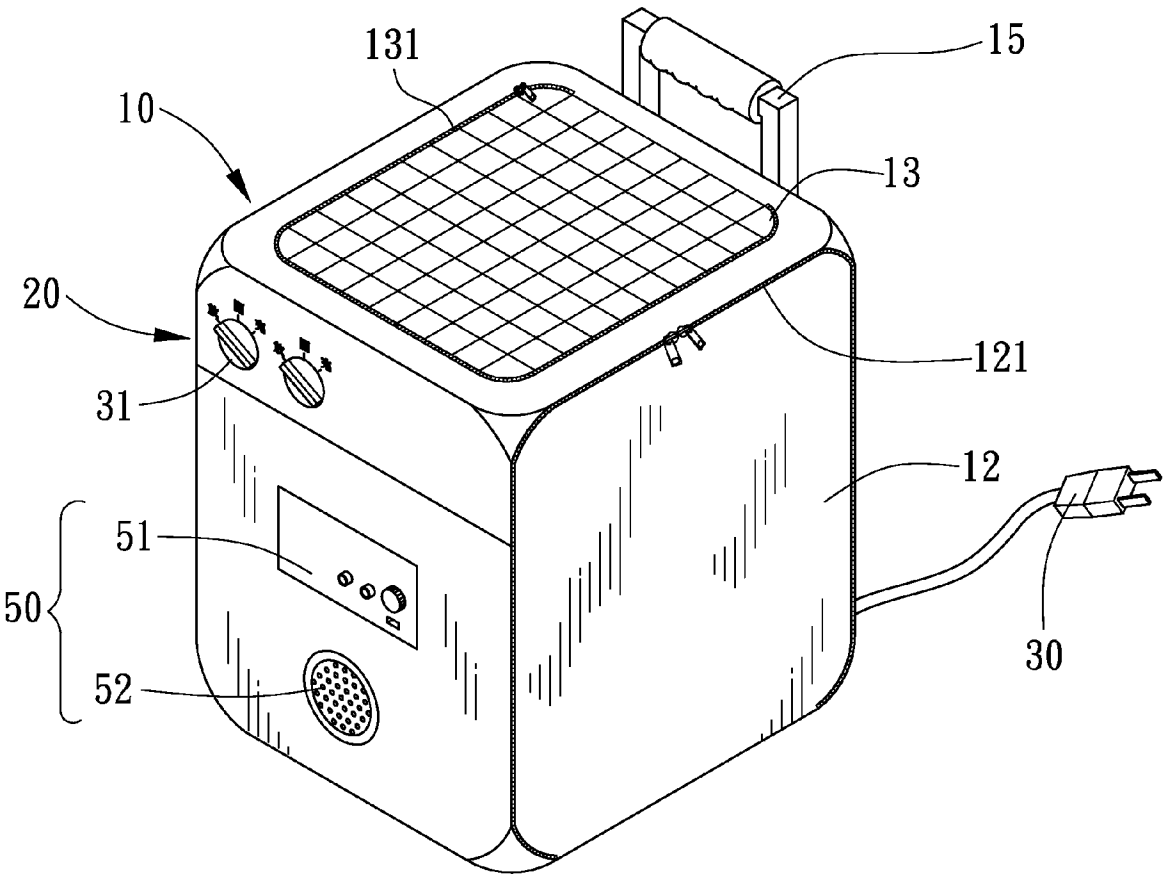
FIG. 2 is a perspective view of an inflatable furniture with a AC power supply in accordance with the present invention.
Figure 3:
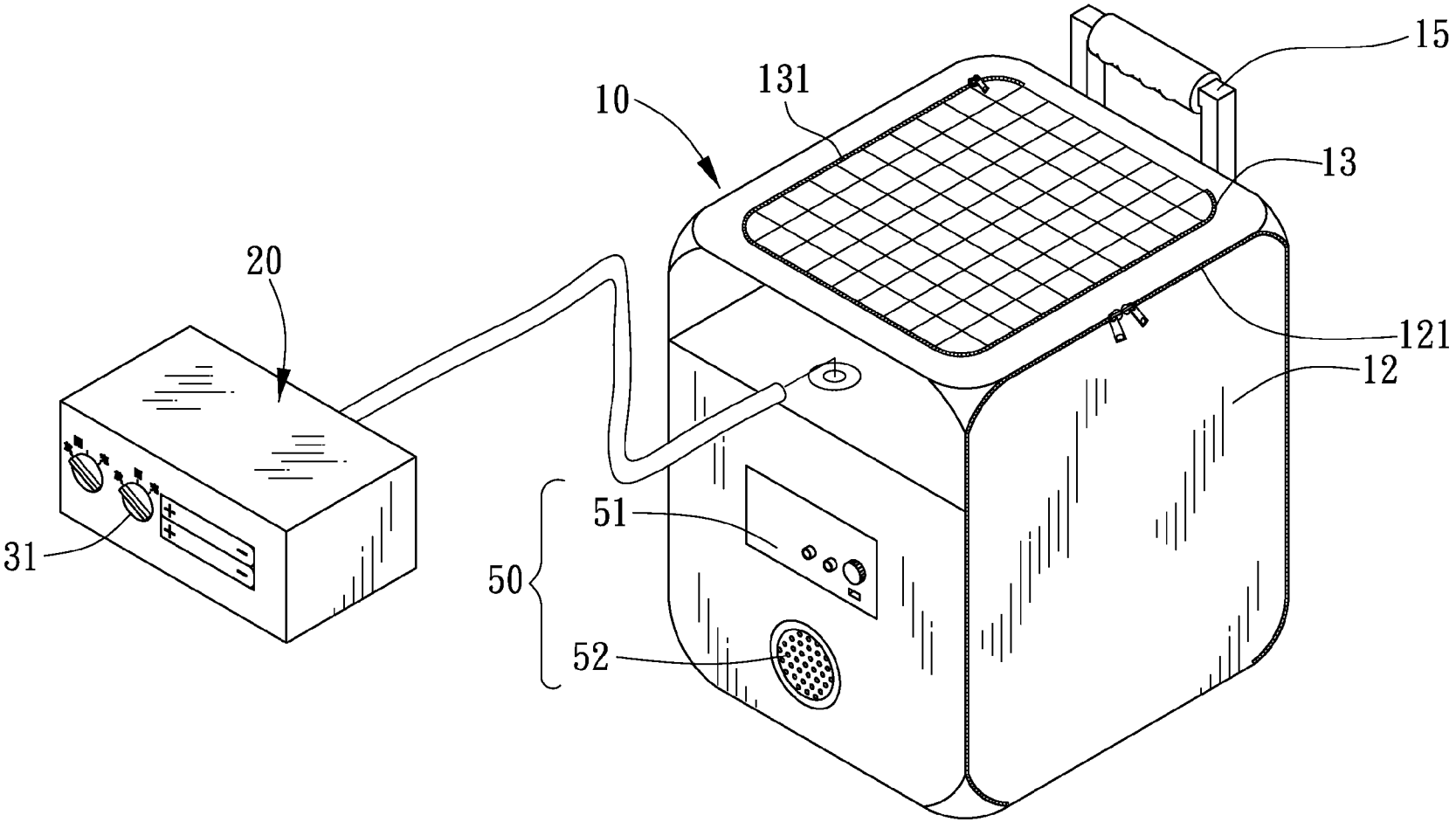
FIG. 3 shows that the pump is externally connected to the inflatable furniture in accordance with the present invention.
Figure 4:
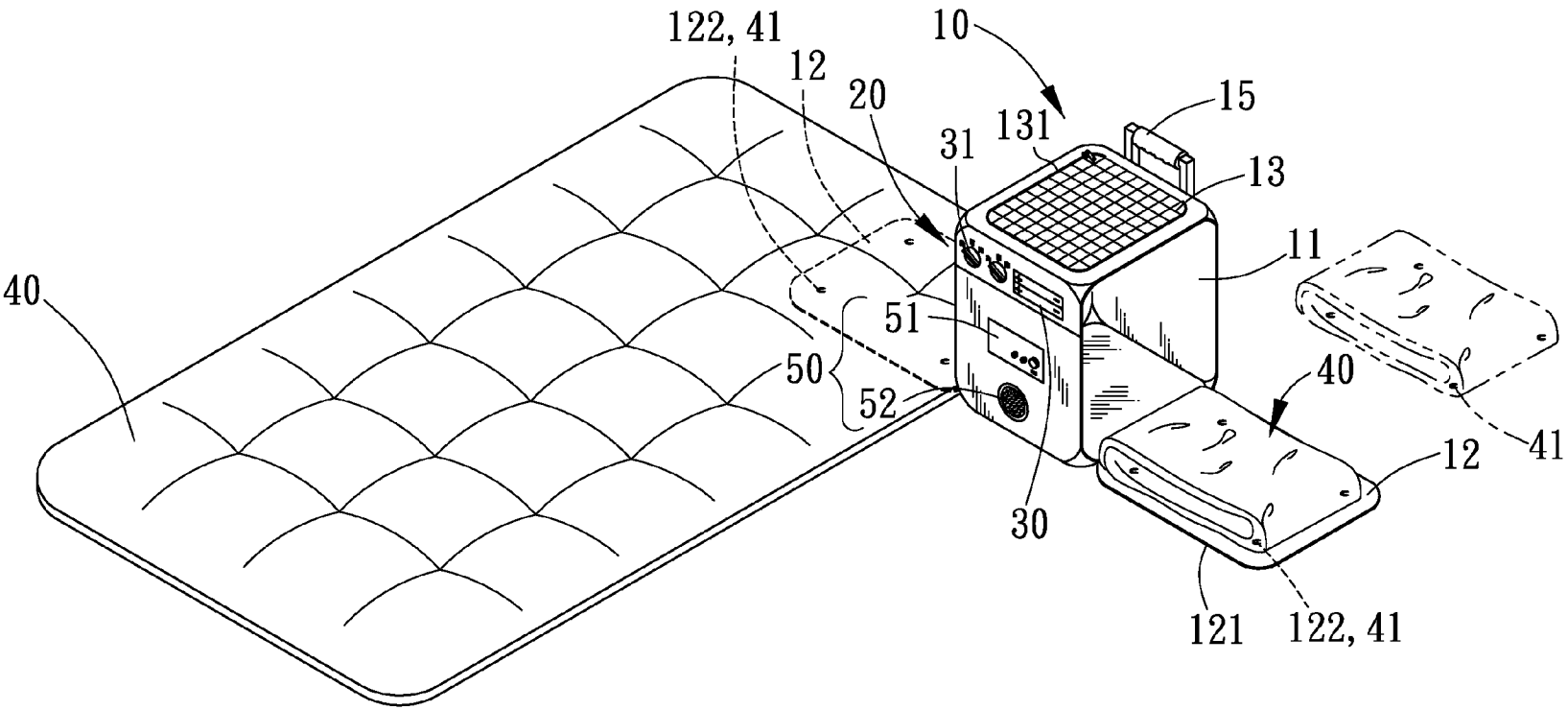
FIG. 4 is an illustrative view in accordance with the present invention, wherein the side boards are opened, the airbags are not inflated and the connecting members are press buttons.
Figure 5:
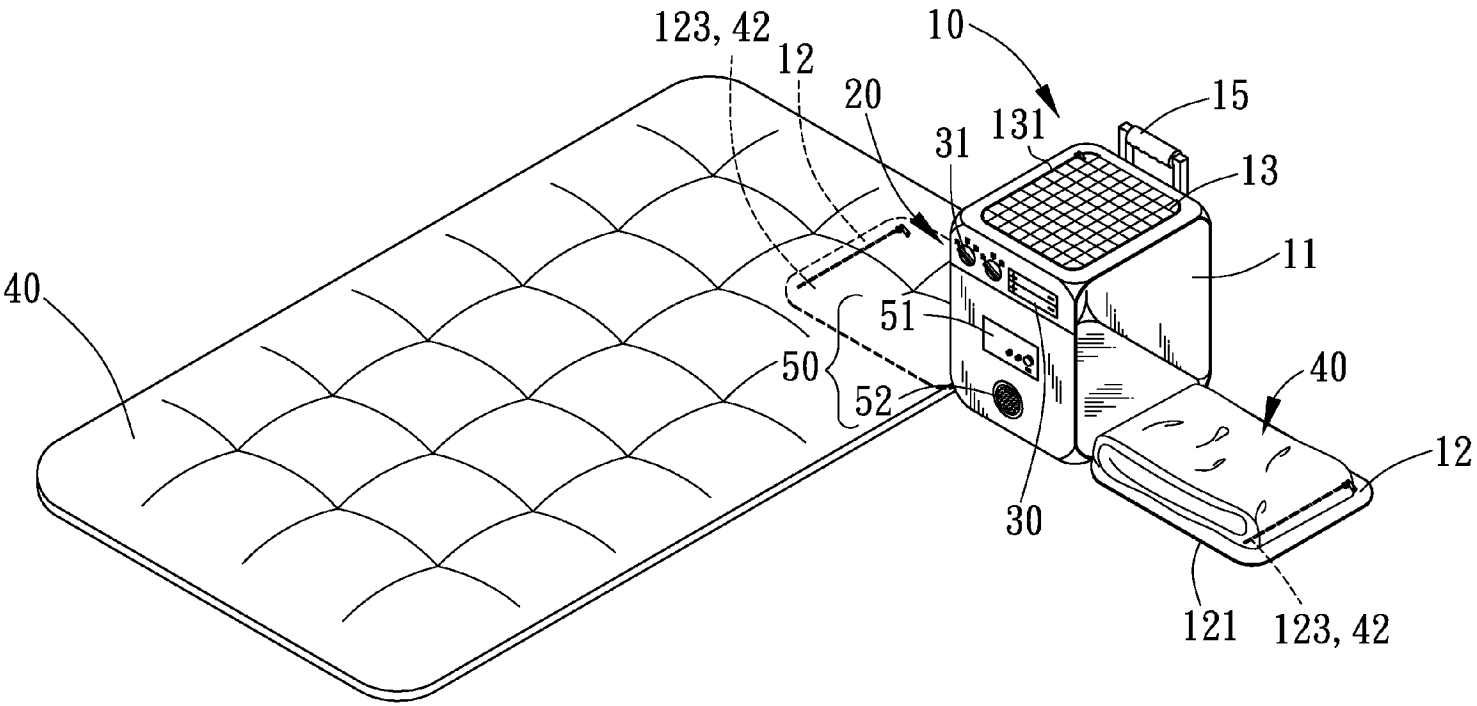
FIG. 5 is an illustrative view in accordance with the present invention, wherein the side boards are opened, the airbags are not inflated and the connecting members are zippers.
Figure 6:
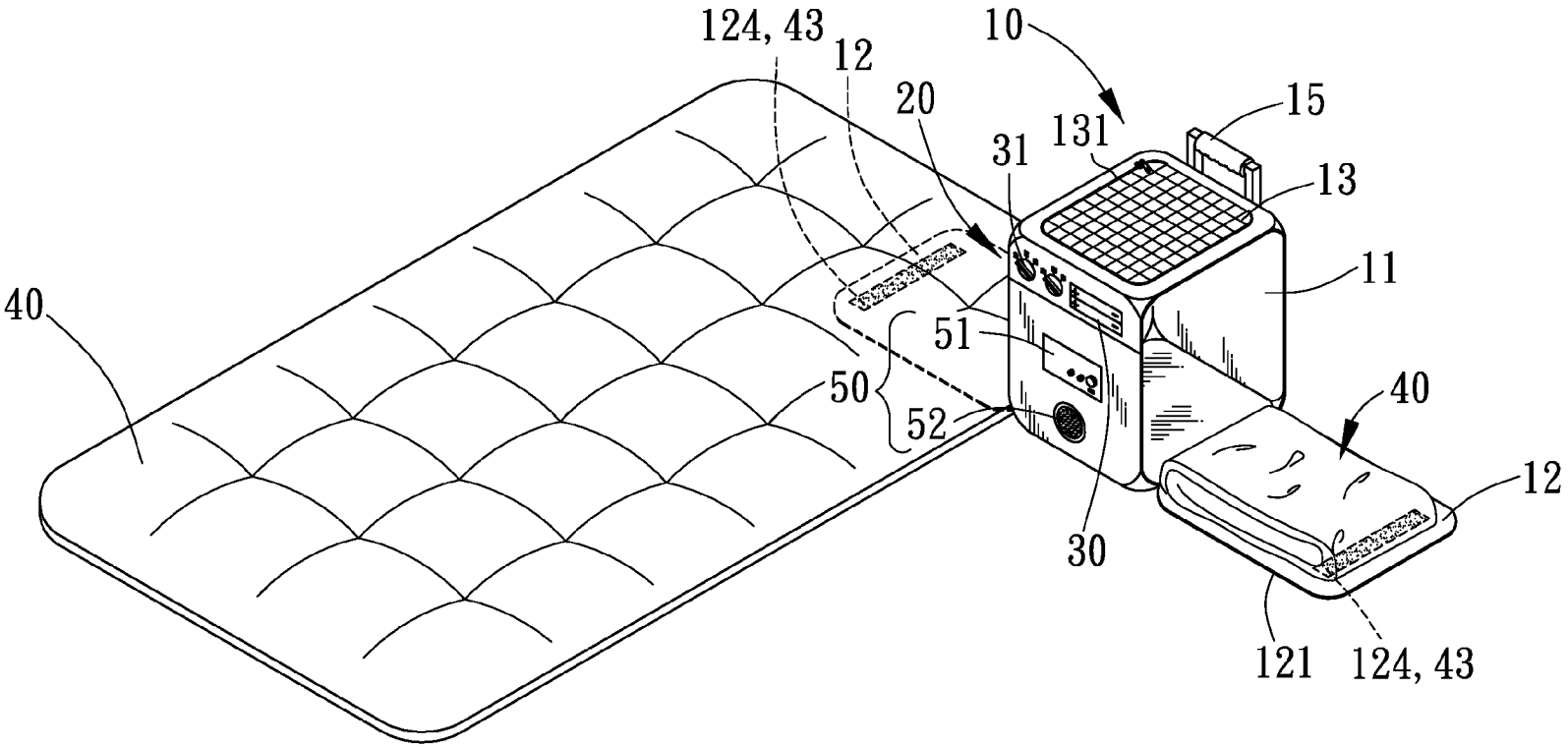
FIG. 6 is an illustrative view in accordance with the present invention, wherein the side boards are opened, the airbags are not inflated and the connecting members are hooks and loops fasteners.
Figure 7:
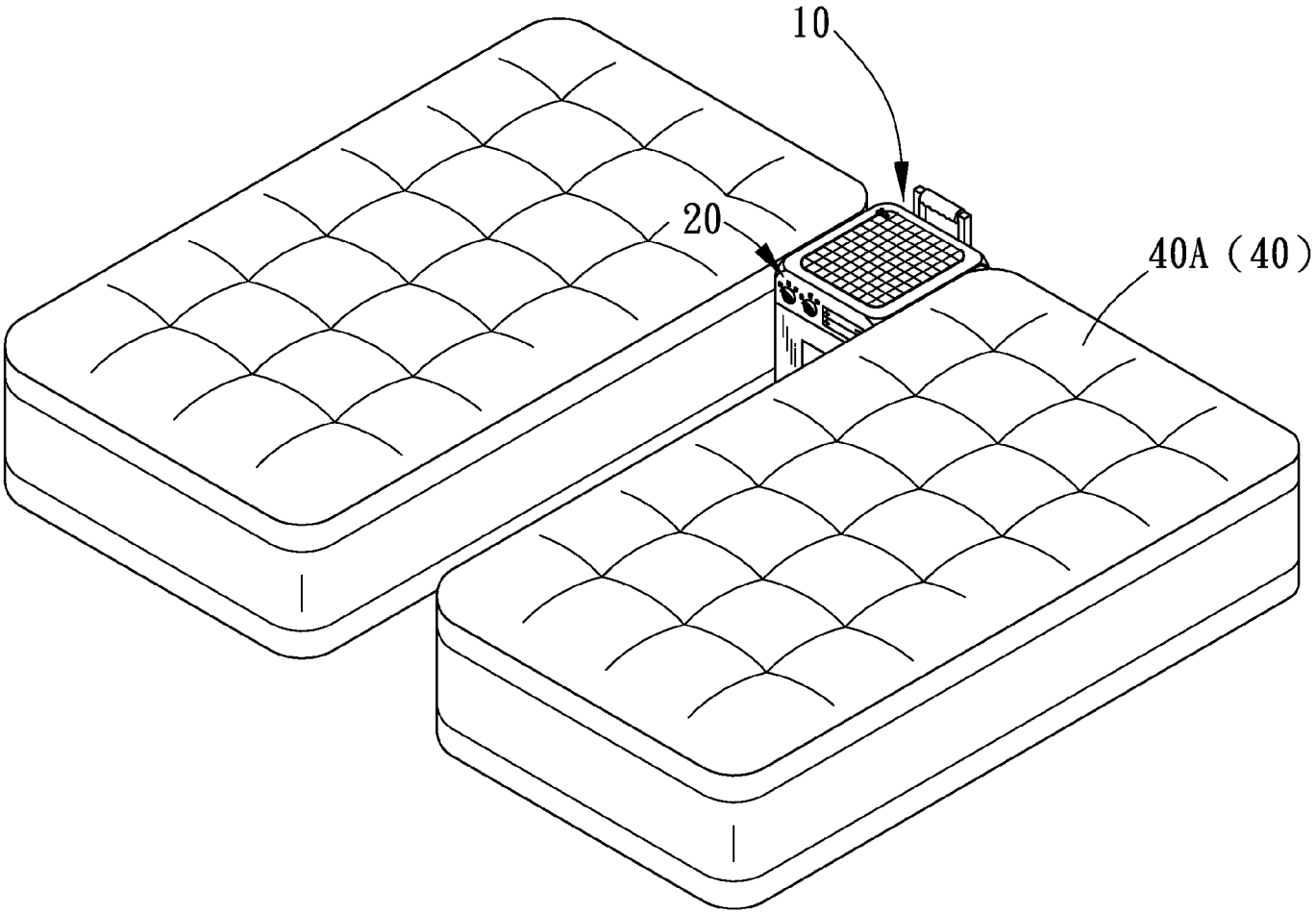
FIG. 7 is an illustrative view in accordance with the present invention showing the two airbags are inflated into beds.

The pump 20 is connected to the receiving body 10, and it can be disposed inside the receiving body 10 (as shown in FIGS. 1 and 2) or can be externally connected to the receiving body 10 (as shown in FIG. 3).

The power supply 30 is disposed in the receiving body 10 and electrically connected to the pump 20 and is further electrically connected to at least one rotary control button 31 which controls ON/OFF of the pump 20. The power supply 30 provides alternating current (AC) power (as shown in FIG. 2) or a direct current (DC) power (as shown in FIG. 1).

The two airbags 40 are connected to the pump 20, they can be inflated into beds 40A, and after deflation, they can be folded up onto the side boards 12 of the receiving body 10 and retracted into the receiving space 11.

The airbag-connecting members can take the forms of pressing buckles 41, zippers 42 or hooks and loops fastener 43, they are disposed on the airbags 40 and located corresponding to the side-board-connecting members on the side boards 12 of the receiving body 10. When the side boards 12 of the receiving body 10 are opened, the airbags 40 are connected to the side boards 12 through the airbag-connecting members and side-board-connecting members. Of course, when the side boards 12 are opened, the airbags 40 can also be detached from the side boards 12.

On the receiving body 10 is provided an audio device 50 having an audio input portion 51 for connecting to a flash disc or other input cables and an audio output portion 52 for playing sound effects.

The airbags 40 are folded and fixed to the inner surface of the side boards 12 of the receiving body 10. To use the airbags 40, the user can unzip the zipper 121 on the respective side boards 12 and open the side boards 12, then use the rotary control button 31 to turn on the pump 20, making the pump 20 inflate the airbags 40. The airbags 40 will be unfolded automatically into beds 40A after inflation. The inflation process is easy and quick. The chessboard 13 on the top of the receiving body 10 acts as a recreational facility by allowing the user to play games. The audio device 50 plays music for the user. The rotary control button 31 of the power supply 30 controls the two airbags 40 separately or simultaneously to inflate or deflate the airbags according to actual needs.

When the user is done using the beds 40A, the beds 40 can be deflated into the airbags 40 again and folded up, and then the side boards 12 of the receiving body 10 are closed to receive the airbags 40 in the receiving body 10. The receiving body 10 can also be temporarily used as a tea table or a stool.

Figure 8:
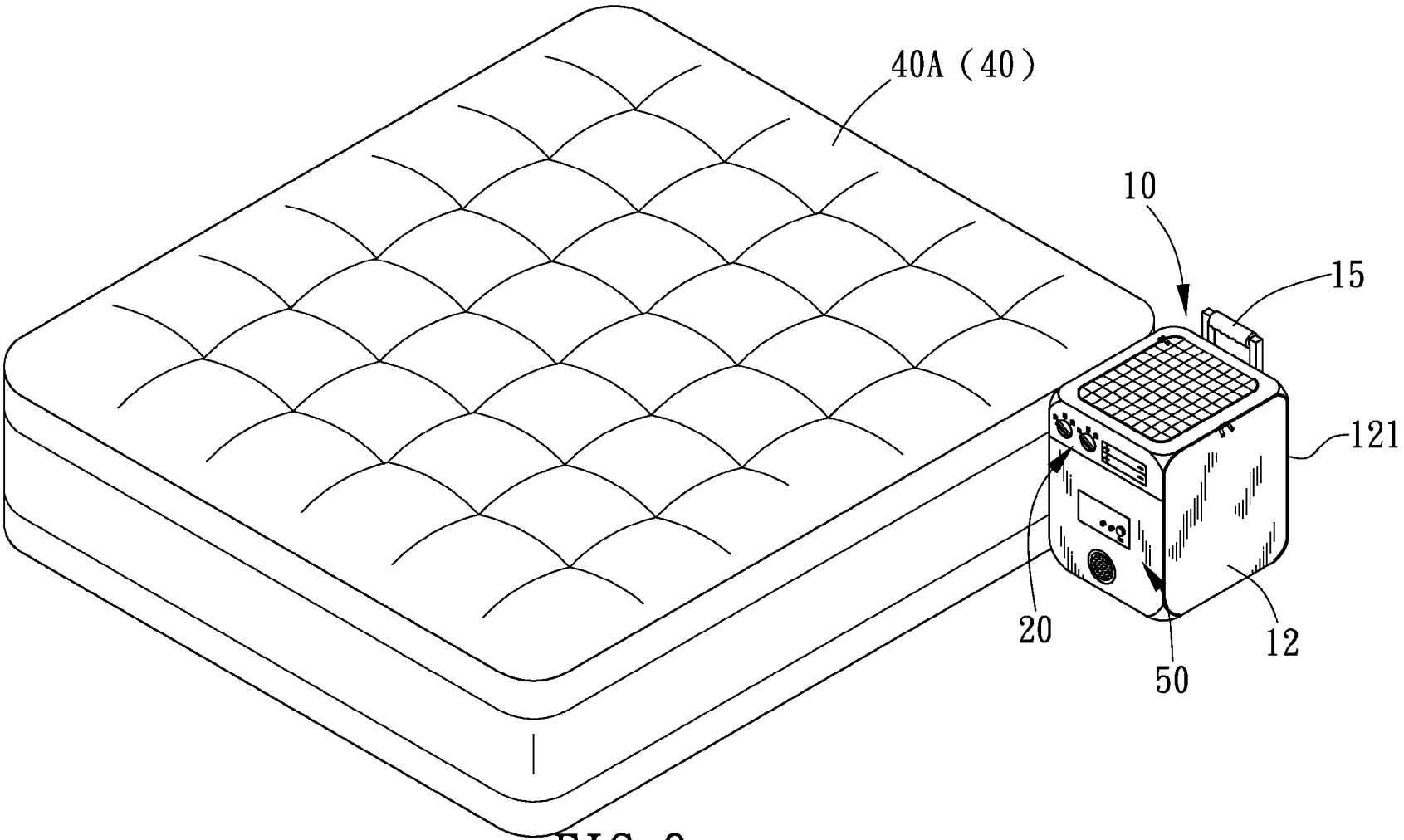
FIG. 8 is an illustrative view in accordance with the present invention showing that only one airbag is inflated into a bed.

As shown in FIG. 8, the user can inflate only one of the two airbags 40, so as to prevent unnecessary space consumption.

Figure 9:
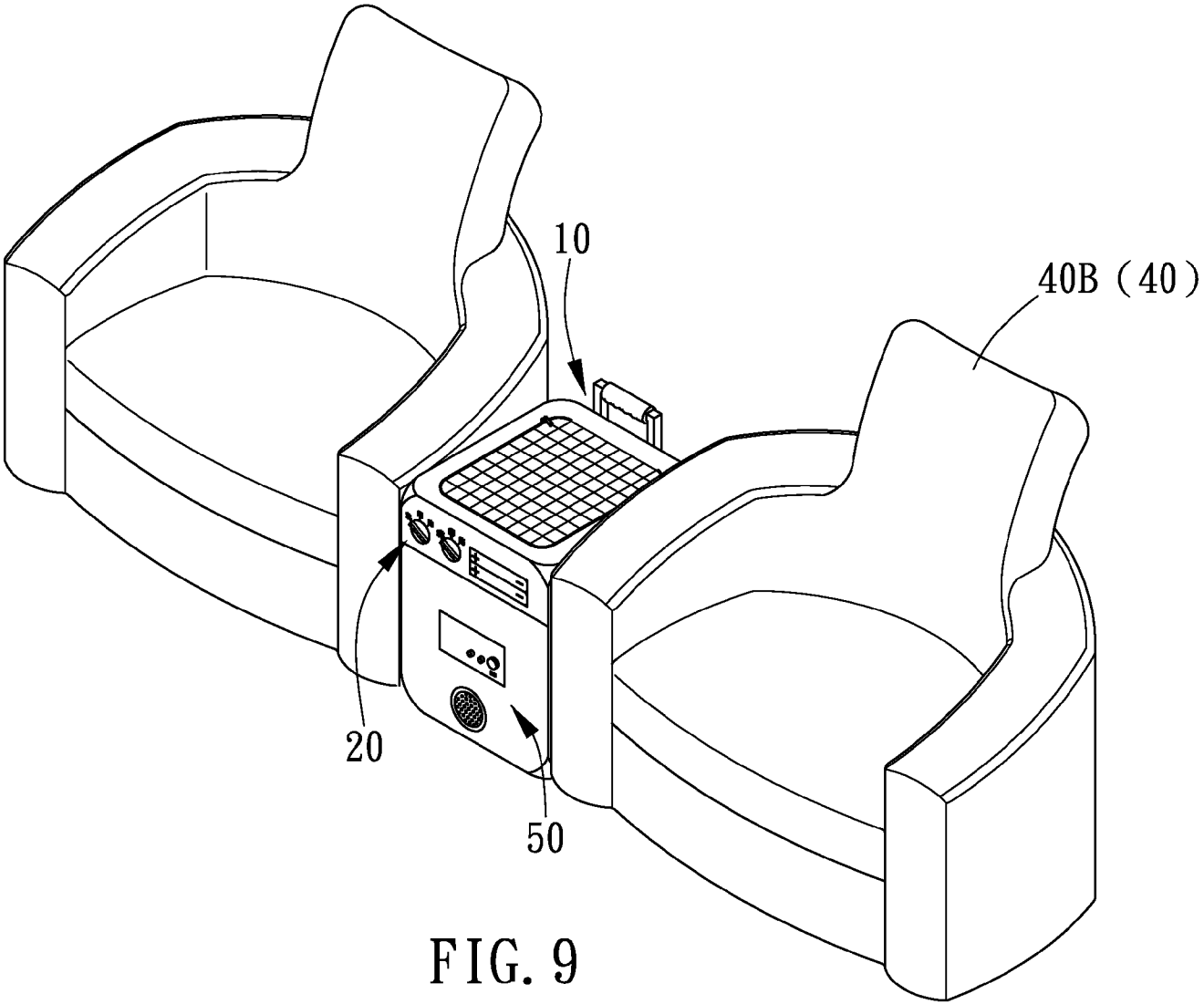
FIG. 9 shows that the two airbags of the present invention can be inflated into two sofas.
Figure 10:
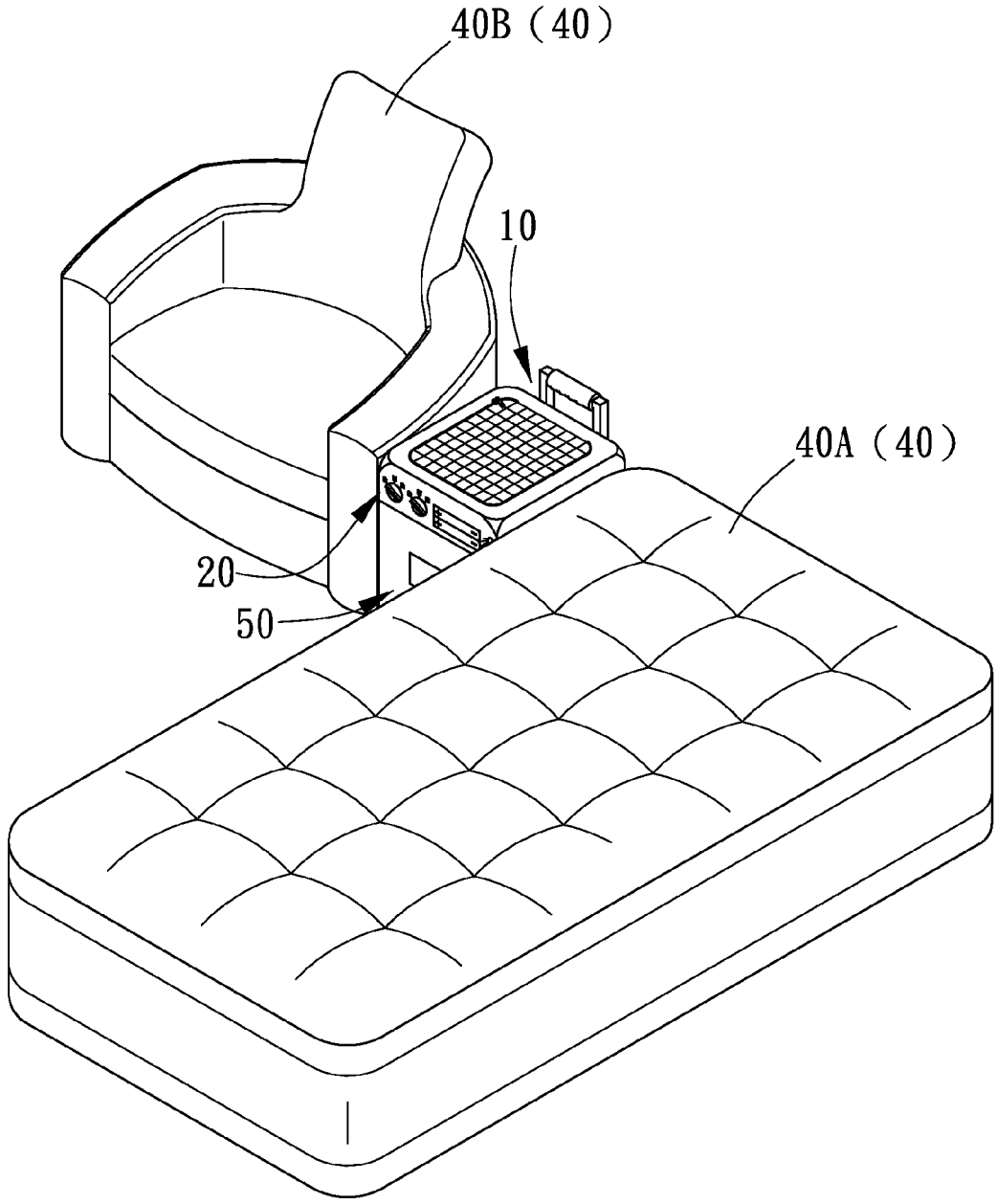
FIG. 10 shows that the two airbags of the present invention are inflated into a sofa and a bed.

Referring then to FIG. 9, the airbags 40 at both sides of the receiving body 10 can also be inflated into a set of sofa 40B, or as shown in FIG. 10, inflated into a sofa 40B and a bed 40A.

Figure 11:
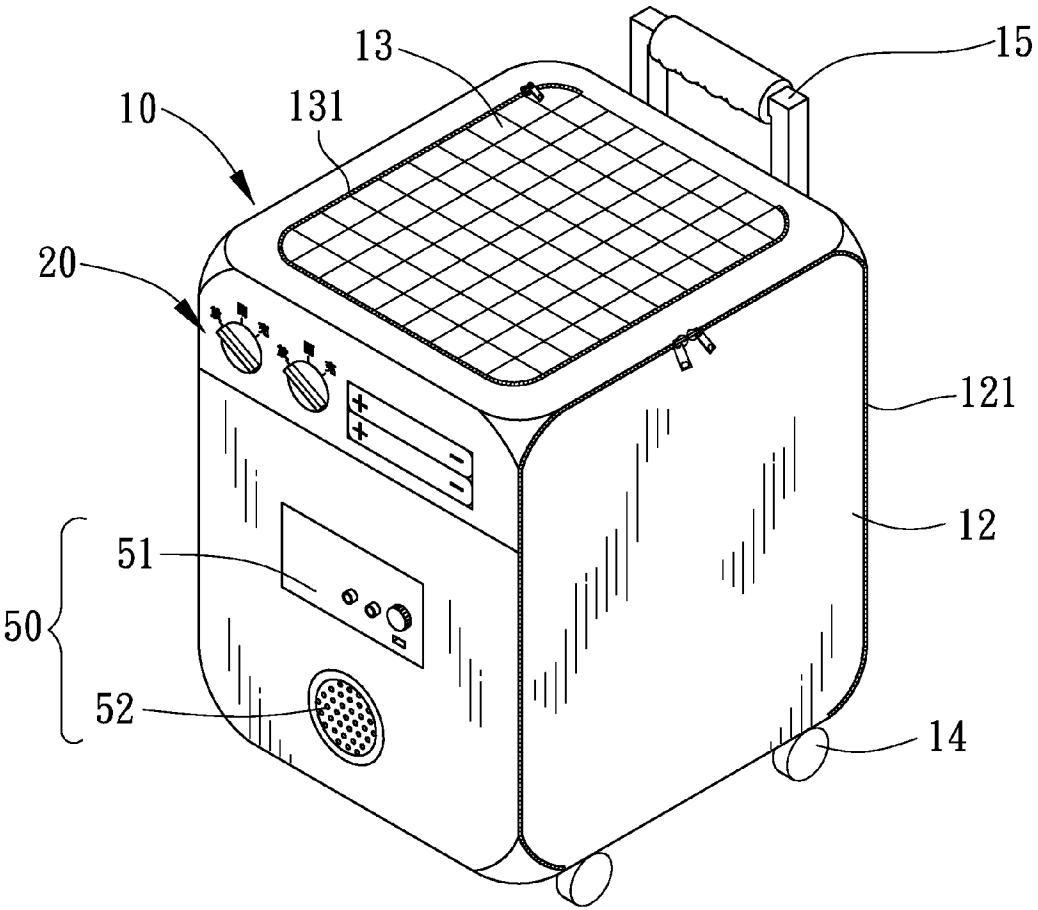
FIG. 11 shows that the receiving body of the inflatable furniture in accordance with the present invention is provided with casters and an extensible handle.
Figure 12:
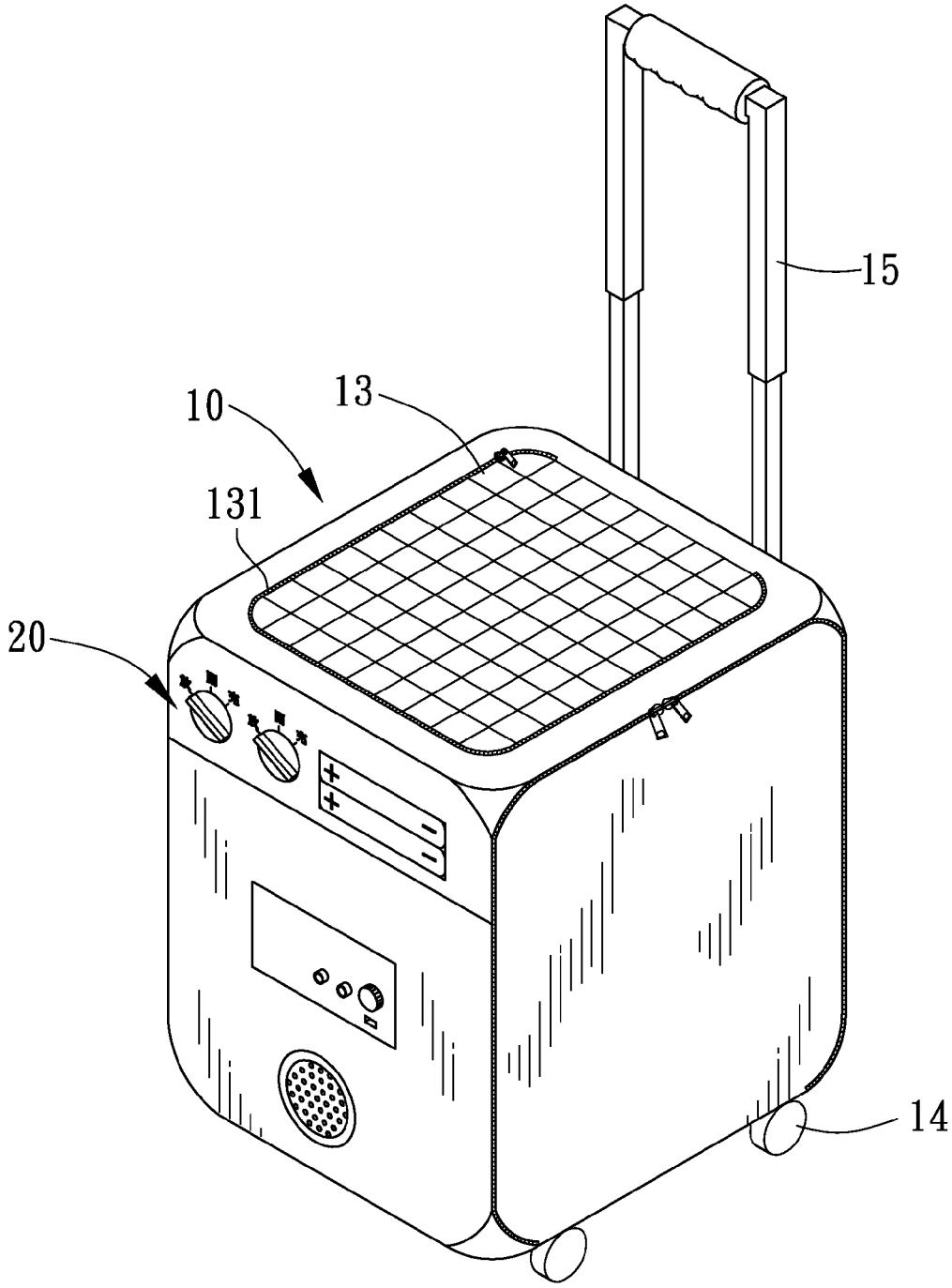
FIG. 12 is an operational view of FIG. 11 showing that the extensible handle is pulled out.

Referring finally to FIGS. 11 and 12, the receiving body 10 can also be provided with a plurality of casters 14 and an extensible handle 15. The extensile handle 15 makes it easy for the user to pull the receiving body 10 to slide with the help of the two casters 14.

While we have shown and described various embodiments in accordance with the present invention, it should be clear to those skilled in the art that further embodiments may be made without departing from the scope of the present invention.

What is claimed is:

1. An inflatable furniture comprising:

a receiving body having a receiving space and two side boards capable of being opened laterally, each of the side boards being provided with a zipper around an outer periphery thereof for allowing the side boards to be zipped up to close the receiving space or allowing the side boards to be unzipped and laid on the ground;

a plurality of side-board-connecting members connected to an inner surface of the respective side boards;

a pump connected to the receiving body;

a power supply electrically connected to the pump and at least one rotary control button which controls ON/OFF of the pump;

two airbags connected to the pump and capable of being inflated into furniture by the pump when the side boards are opened; and a plurality of airbag-connecting members disposed on the airbags and located corresponding to the side-board-connecting members on the side boards of the receiving body, when the side boards of the receiving body are opened, the airbag-connecting members the airbags and the side-board-connecting members enable the airbags to be connected to or detached from the side boards.

2. The inflatable furniture as claimed in claim 1, wherein the power supply is disposed in the receiving body.

3. The inflatable furniture as claimed in claim 1, wherein the airbag-connecting members the airbags and the side-board-connecting members take the forms of pressing buckles, zippers, and hooks and loops fastener.

4. The inflatable furniture as claimed in claim 1, wherein a chessboard is provided on an outer surface of a top of the receiving body, the chessboard takes the form of Chinese chess, Caissa Chess and five chess.

5. The inflatable furniture as claimed in claim 4, wherein the chessboard is provided around an outer periphery thereof with a zipper for closing or opening the chessboard.

6. The inflatable furniture as claimed in claim 1, wherein an audio device is provided on the receiving body, the audio device has an audio input portion for connecting to a flash disc or other input cables and an audio output portion for playing sound effects.

7. The inflatable furniture as claimed in claim 1, wherein the power supply provides an alternating current power plug or direct current power.

8. The inflatable furniture as claimed in claim 1, wherein the receiving body is provided with a plurality of casters.

9. The inflatable furniture as claimed in claim 1, wherein the receiving body is provided with an extensible handle.

10. The inflatable furniture as claimed in claim 1, wherein the airbags are inflated into a sofa or beds.

11. The inflatable furniture as claimed in claim 1, wherein the pump is connected to and disposed in the receiving body or externally connected to the receiving body.

* * * * *